US006642778B2

(12) United States Patent
Opris

(10) Patent No.: US 6,642,778 B2
(45) Date of Patent: Nov. 4, 2003

(54) LOW-VOLTAGE BANDGAP REFERENCE CIRCUIT

(76) Inventor: Ion E. Opris, 2198 Lark Hills Ct., San Jose, CA (US) 95138

( * ) Notice: Subject to any disclaimer, the term of this patent is extended or adjusted under 35 U.S.C. 154(b) by 0 days.

(21) Appl. No.: 10/375,472

(22) Filed: Feb. 27, 2003

(65) Prior Publication Data

US 2003/0137342 A1 Jul. 24, 2003

Related U.S. Application Data

(62) Division of application No. 10/141,597, filed on May 7, 2002, now Pat. No. 6,549,065, which is a division of application No. 09/804,779, filed on Mar. 13, 2001, now Pat. No. 6,407,622.

(51) Int. Cl.[7] ..... G05F 1/10

(52) U.S. Cl. ..... 327/539; 327/534; 323/312; 323/313

(58) Field of Search ..... 327/539, 534; 323/312, 313, 314, 315, 316

(56) References Cited

U.S. PATENT DOCUMENTS 5,789,906 A * 8/1998 Mizuide ..... 323/313
6,242,897 B1 * 6/2001 Savage et al. ..... 323/313
6,529,066 B1 * 3/2003 Guenot et al. ..... 327/539

* cited by examiner

*Primary Examiner*—Tuan T. Lam
*Assistant Examiner*—Hiep Nguyen
(74) *Attorney, Agent, or Firm*—Fliesler Dubb Meyer & Lovejoy, LLP

(57) ABSTRACT

A low-voltage reference circuit is provided wherein (i) the output voltage can be set to be a fraction of the silicon bandgap voltage of 1.206 volts, or on the order of 0.9 volts, (ii) the output voltage can have a zero thermal coefficient (TC), and (iii) the operating supply voltage Vcc can be less than 1.5 volts, or on the order of 1.1 volts. In one embodiment, the reference circuit modifies a conventional Brokaw bandgap circuit to lower both the required Vcc level and the output voltage by a constant offset. Referring to FIG. 3, the modification includes adding bipolar transistor (Q6), an opamp (A3) and resistors (R5, R6 and R7). In another embodiment, the reference circuit modifies a conventional circuit with PNP transistors connected to the substrate, referring to FIG. 4, by adding current source I6, NMOS transistor M3, opamp A4 and resistors R8–R10. A further embodiment modifies FIG. 4, referring to FIG. 5, by omitting the current source I6, and moving the location of resistor R4.

3 Claims, 3 Drawing Sheets

LOW-VOLTAGE BANDGAP REFERENCE CIRCUIT

RELATED APPLICATIONS

This application claims priority to divisional application Ser. No. 10/141,597 now U.S. Pat. No. 6,549,062, filed May 7, 2002, which is a divisional of application Ser. No. 09/804,779 now U.S. Pat. No. 6,407,622, filed Mar. 13, 2001.

I. BACKGROUND OF THE INVENTION

A. Field of the Invention

The present invention relates to constant voltage reference circuits. More particularly, the present invention relates to a bandgap voltage reference circuit wherein (i) the output voltage can be low and set relative to the silicon bandgap voltage, (ii) the output voltage can have a zero TC, and (iii) the operating supply voltage $V_{cc}$ can be limited.

B. Description of the Related Art

So-called bandgap reference circuit produces an output voltage that is approximately equal to the silicon bandgap voltage of 1.206 V (hereinafter termed simply the "bandgap voltage") with a zero temperature coefficient ("TC").

1. FIG. 1—Prior Art

FIG. 1 shows a prior art bandgap reference circuit, sometimes called the Brokaw bandgap circuit. This circuit is built with current sources $I_1$–$I_2$, npn bipolar junction transistors $Q_1$–$Q_2$, resistors $R_1$–$R_2$, and operational amplifier ("opamp") $A_1$. Opamp $A_1$ has a negative input terminal (node $n_1$), a positive input terminal (node $n_2$), and an output terminal (node $n_3$).

Current sources $I_1$–$I_2$ are implemented so that each current source produces a substantially equal current I. This can be done, for example, by utilizing p-channel MOS transistors. In such an implementation, the source of each PMOS transistor is connected to $V_{cc}$, and the gates of the PMOS transistors are connected together in a current mirror configuration to node $n_1$.

Transistor $Q_2$ is N times larger in size than transistor $Q_1$. Initially, with $Q_2$ larger than $Q_1$ and equal current from $I_1$–$I_2$, the voltage across $Q_1$ will be N times larger than the voltage across $Q_2$. Thus, node $n_1$ will be driven higher than node $n_2$. This will cause the voltage at node $n_3$ to increase. The bases of transistors $Q_1$ and $Q_2$ are connected to node $n_3$, so increasing the voltage at node $n_3$ causes current I from current sources $I_1$–$I_2$ to increase. Current I will increase until the voltage across resistor $R_1$ balances the voltage difference between transistors $Q_1$ and $Q_2$.

The equilibrium value for the current I is given by $$I = \frac{\Delta V_{BE}}{R_1} \tag{1}$$

The difference in the base-emitter voltage of the two transistors $Q_1$ and $Q_2$ is expressed as $$\Delta V_{BE} = \frac{kT}{q} \cdot \ln(N) \tag{2}$$

Because $\Delta V_{BE}$ is a function of thermal voltage kT/q, it is said to be proportional to absolute temperature (PTAT).

The output voltage $V_{out1}$ in FIG. 1 is expressed as $$V_{out1} = V_{BE_1} + \frac{2 \cdot R_2}{R_1} \cdot \Delta V_{BE} \tag{3}$$

Three observations can be made about $V_{out1}$. First, for a certain ratio of the resistors $R_1$ and $R_2$, $V_{out1}$ becomes equal to the silicon bandgap voltage. Second, $V_{out1}$ does not depend on the absolute value of the resistors used, which is hard to control. Third, $V_{out1}$ is temperature independent—that is, it has a zero TC.

B. FIG. 2—Prior Art

Most modern CMOS processes have only substrate pnp bipolar junction transistors available. In this case the collector of the pnp transistor is forced to be the VSS/ground node. The configuration for a bandgap reference circuit using this type of bipolar junction transistor is shown in FIG. 2.

The circuit of FIG. 2 is built with current sources $I_3$–$I_5$, pnp bipolar junction transistors $Q_3$–$Q_5$, resistors $R_3$–$R_4$, and opamp $A_2$ Opamp $A_2$ has a negative input terminal (node $n_4$), a positive input terminal (node $n_5$), and an output terminal (node $n_6$).

Current sources $I_3$–$I_5$ are implemented so that each current source produces a substantially equal current I. As described above, this can be done by utilizing PMOS transistors.

Transistor $Q_4$ is N times larger in size than transistors $Q_3$ and $Q_5$. Initially, with $Q_4$ larger than $Q_3$ and $Q_5$ and equal current from $I_3$–$I_5$, the voltage across $Q_3$ and $Q_5$ will be N times larger than the voltage across $Q_4$. Thus, node $n_4$ will be driven higher than node $n_5$. This will cause node $n_6$ to increase, causing the current I from current sources $I_3$–$I_5$ to increase. Current I will increase until the voltage across resistor $R_3$ balances the voltage difference between transistor $Q_4$ and transistors $Q_3$ and $Q_5$.

In this case, the output voltage $V_{out2}$ in FIG. 2 is expressed as $$V_{out2} = V_{BE_5} + \frac{R_4}{R_3} \cdot \Delta V_{BE} \tag{4}$$

As with $V_{out1}$ in FIG. 1, $V_{out2}$ can be set equal to the silicon bandgap voltage, $V_{out2}$ is temperature independent, and $V_{out2}$ does not depend on the absolute value of the resistors used.

The prior art circuits of FIGS. 1 and 2 cannot work with supply voltages below about 1.5 V, since the bandgap voltage with a zero TC is about 1.2 V for silicon. Many applications, however, require the voltage reference circuit to operate with a voltage supply below 1.5 V. The present invention presents such a circuit.

II. SUMMARY OF THE INVENTION

In accordance with the present invention, a bandgap voltage reference circuit is provided wherein (i) the output voltage can be a fraction of the silicon bandgap voltage, (ii) the output voltage can have a zero TC, and (iii) the operating supply voltage can be less than 1.5 V.

In one embodiment of the present invention, the prior art Brokaw bandgap circuit of FIG. 1 is modified so that the operating supply voltage Vcc is lowered together with the output voltage by a constant offset. Referring to FIG. 3, the offset is created using an additional npn bipolar junction transistor (Q2), an opamp (A3) and a plurality of resistors (R5, R6 and R7).

In further embodiments of the present invention, the prior art bandgap reference circuit of FIG. 2 is modified so that the operating supply voltage is lowered together with the output voltage by a constant offset. In one embodiment, referring to FIG. 4, the offset is created using an additional current source 16, NMOS transistor M3, opamp A4, and resistors R8–R10. In another embodiment the offset is created, referring to FIG. 5, by modifying FIG. 4 to omit current source 16, and the resistor R4 shown connected in FIG. 4 is moved to the emitter of transistor Q5.

III. BRIEF DESCRIPTION OF THE DRAWINGS

Further details of the present invention are explained with the help of the attached drawings in which.

IV. DETAILED DESCRIPTION

A. FIG. 3

Figure 1:
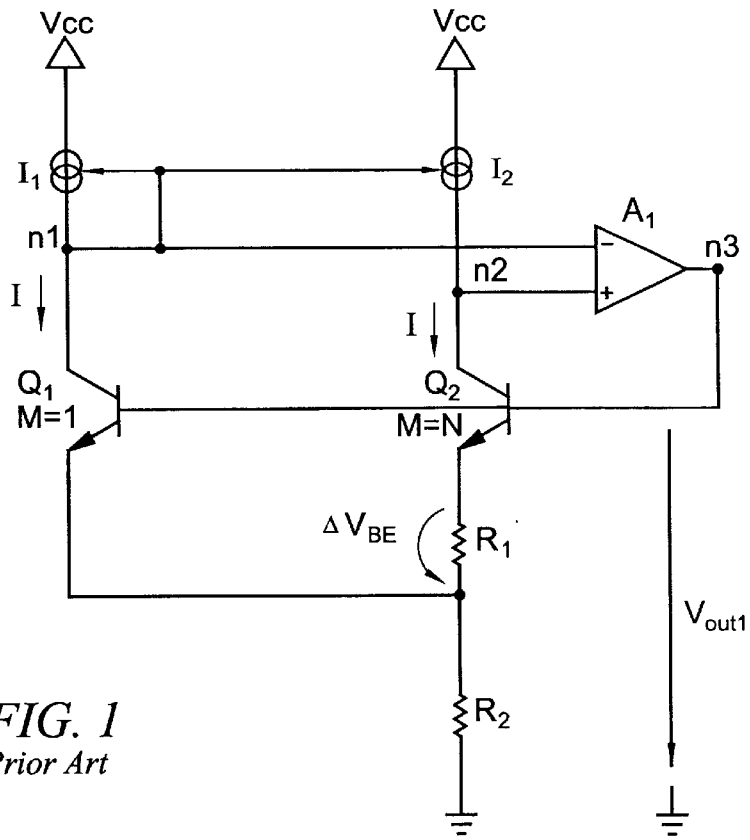
FIG. 1 Prior Art
FIG. 1 is a circuit diagram showing the prior art Brokaw bandgap reference circuit.
Figure 3:
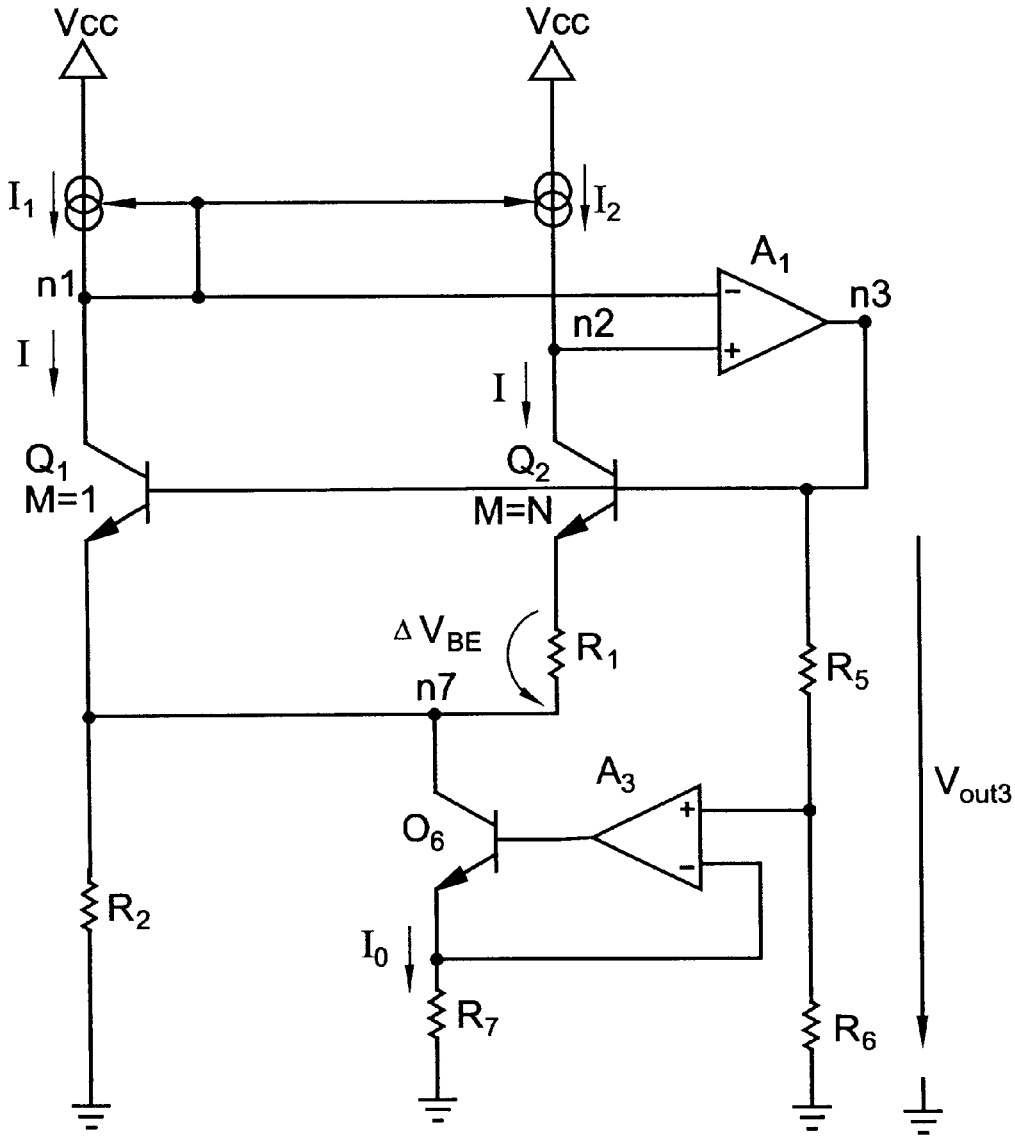
FIG. 3 is a circuit diagram showing a low-voltage reference circuit in accordance with the present invention.

FIG. 3 shows a low-voltage reference circuit in accordance with the present invention. Like the prior art Brokaw bandgap circuit shown in FIG. 1, the circuit of FIG. 3 contains current sources $I_{1-I2}$, npn bipolar junction transistors $Q_1$–$Q_2$, resistors $R_1$–$R_2$, and opamp $A_1$. Opamp $A_1$ has a negative input terminal (node n), a positive input terminal (node $n_2$), and an output terminal (node $n_3$). In addition, the circuit of FIG. 3 comprises an npn bipolar junction transistor $Q_6$, resistors $R_5$–$R_7$, and opamp $A_3$.

The output of opamp $A_3$ drives the base of transistor $Q_6$, which has a collector drawing an offset current from node $n_7$. This offset current $I_O$ is directed through resistor $R_7$. The voltage on $R_7$ is set by the $R_5$–$R_6$ tap from the output voltage $V_{out3}$ using opamp $A_3$. Thus, the magnitude of offset current $I_O$ through $R_7$ is expressed as $$I_O = \frac{R_6}{R_5 + R_6} \cdot \frac{1}{R_7} \cdot V_{out3} \tag{5}$$

Neglecting all of the base currents, the output voltage $V_{out3}$ in FIG. 3 is determined by $$V_{out3} = V_{BE1} + 2\frac{R_2}{R_1} \cdot \Delta V_{BE} - I_O \cdot R_2 \tag{6}$$

Recalling equation 2, equation 5 can be rewritten as $$V_{out3} = V_{out1} - I_O \cdot R_2 \tag{7}$$

which can be reduced to $$V_{out3} = \frac{V_{out1}}{1 + \frac{R_4}{R_3 + R_4} \cdot \frac{R_2}{R_5}} \tag{8}$$

Thus, for certain resistor ratios, $V_{out3}$ can be made to be an exact fraction of the bandgap voltage, with a zero TC.

The supply voltage $V_{cc}$ must be set sufficiently high so that $Q_6$ is maintained in saturation. The output voltage $V_{out3}$ has to be set sufficiently high so that transistors $Q_1$ and $Q_2$ are turned on. In one embodiment, $V_{out3}$ is preferably chosen to be about 0.9 V, which can be maintained for a supply voltage Vcc as low as 1.1 V. Further reduction in the operating supply voltage Vcc can be obtained for a reduced temperature range.

Thus, the circuit of FIG. 3 is a bandgap reference circuit wherein (i) the output voltage can be set equal to or less than the silicon bandgap voltage by adjusting resistor ratios, (ii) the output voltage can have a zero TC, and (iii) the operating supply voltage can be less than 1.5 V.

B. FIG. 4

Figure 2:
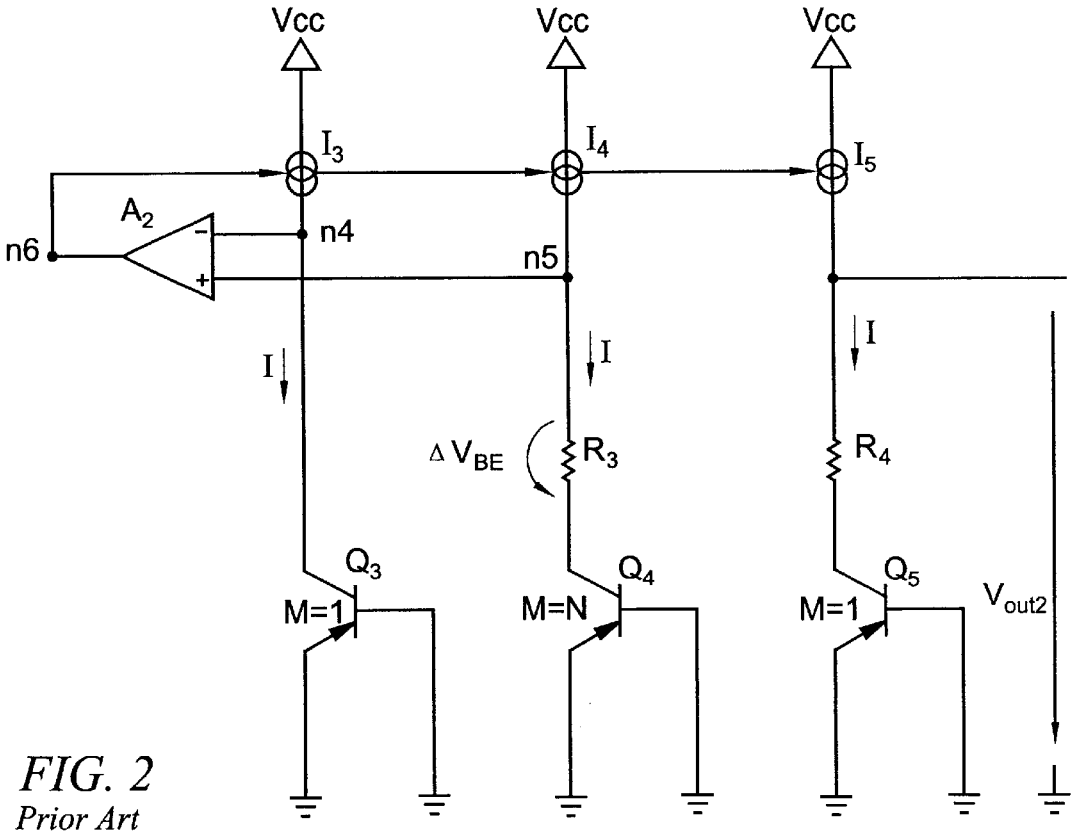
FIG. 2 Prior Art
FIG. 2 is a circuit diagram showing a prior art bandgap reference circuit implemented with substrate pnp bipolar junction transistors.
Figure 4:
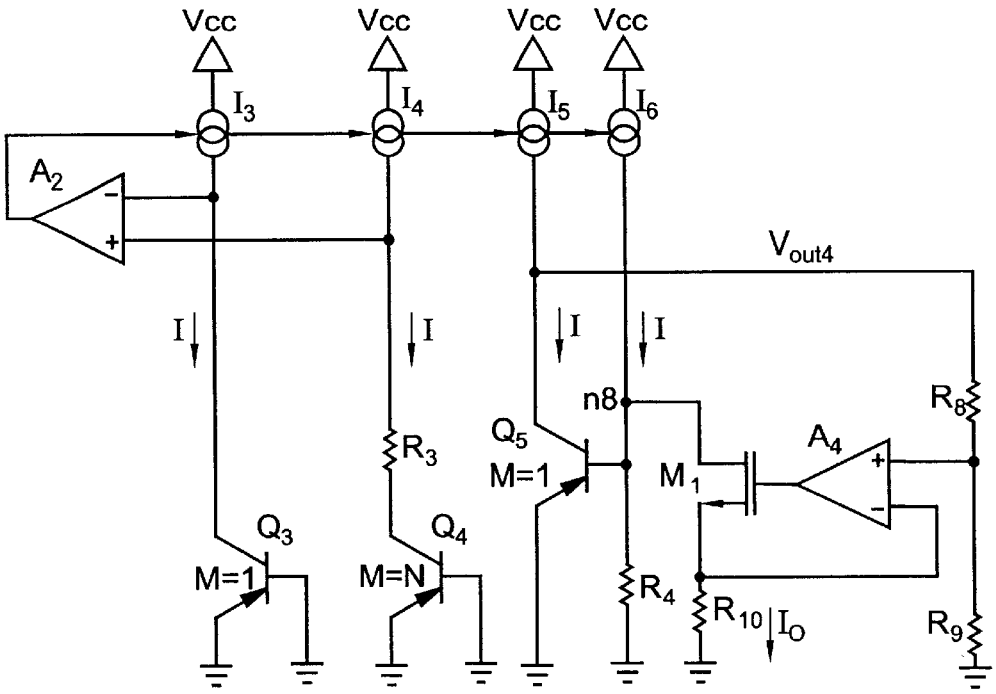
FIG. 4 is a circuit diagram showing a low-voltage reference circuit in accordance with the present invention.

FIG. 4 shows an embodiment of the present invention implemented with substrate pnp bipolar transistors. As with the circuit shown in FIG. 2, the circuit shown in FIG. 4 comprises current sources $I_3$–$I_5$, pnp bipolar junction transistors $Q_3$–$Q_5$, opamp $A_2$, and resistors $R_3$–$R_4$. In addition, the circuit shown in FIG. 4 comprises current source $I_6$, NMOS transistor $M_1$, opamp $A_4$, and resistors $R_8$–$R_{10}$. Instead of being connected between current source $I_5$ and transistor $Q_5$ as in FIG. 2, one terminal of resistor $R_4$ is connected to the base of transistor $Q_5$, current source $I_6$, and the drain of NMOS transistor $M_1$ (this terminal of resistor R4 is also referred to as node $n_8$), and the other terminal of resistor $R_4$ is connected to ground.

These additional components form a controlled current source which generates an offset current. In particular, the output of opamp $A_4$ drives transistor $M_1$, which draws an offset current from node $n_8$. This offset current is directed through resistor $R_{10}$. The voltage on $R_{10}$ is set by the $R_8$–$R_9$ tap from the output voltage $V_{out4}$ using opamp $A_4$. Thus, the magnitude of offset current $I_O$ through $R_{10}$ is expressed as $$I_O = \frac{R_9}{R_8 + R_9} \cdot \frac{1}{R_{10}} \cdot V_{out4} \tag{9}$$

The output voltage $V_{out4}$ in FIG. 4 is expressed as $$V_{out4} = V_{BE5} + (I - I_O) \cdot R_4 \tag{10}$$

which can also be expressed as $$V_{out4} = \frac{V_{BE5} + \frac{R_4}{R_3} \cdot \Delta V_{BE}}{1 + \frac{R_9}{R_8 + R_9} \cdot \frac{R_4}{R_{10}}} \tag{11}$$

Therefore, for certain resistor ratios, $V_{out4}$ can be made to be a fraction of the bandgap voltage.

In FIG. 4, the output voltage $V_{out4}$ has to be set sufficiently high so that transistors Q3, Q4 and $Q_5$ are turned on. As with the circuit of FIG. 3, in one embodiment $V_{out4}$ is chosen to be about 0.9 V, which can be maintained for a supply voltage as low as 1.1 V. Further reduction in the operating supply voltage can be obtained for a reduced temperature range.

Thus, the circuit of FIG. 4 is a bandgap reference circuit wherein (i) the output voltage can be set equal to or less than the silicon bandgap voltage by adjusting resistor ratios, (ii) the output voltage can have a zero TC, and (iii) the operating supply voltage can be less than 1.5 V.

C. FIG. 5

Figure 5:
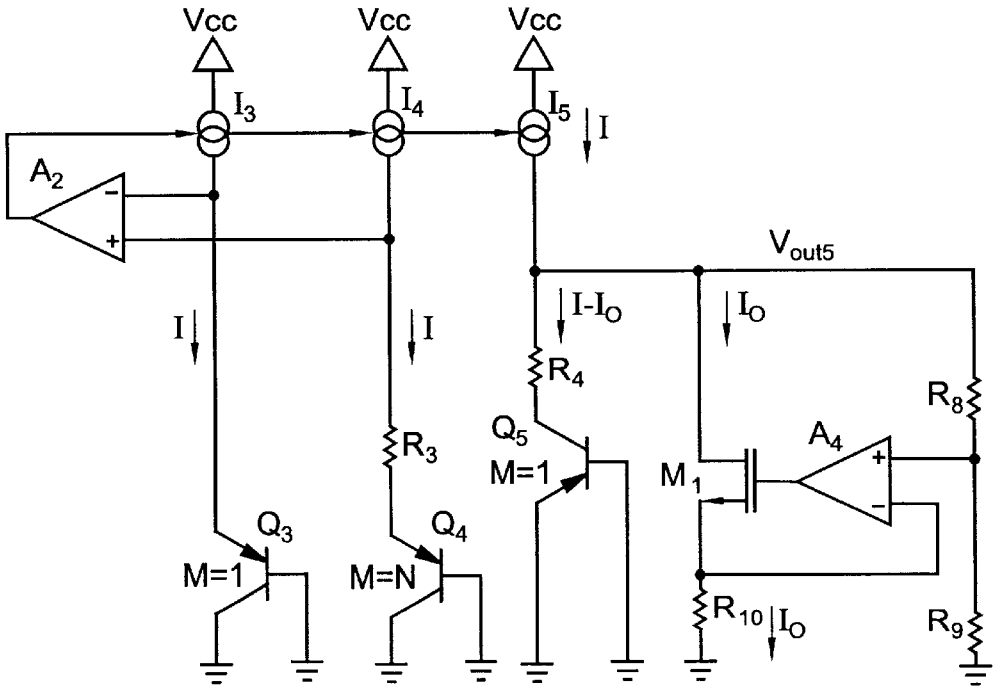
FIG. 5 is a circuit diagram showing a low-voltage reference circuit in accordance with the present invention.

FIG. 5 shows another embodiment of the present invention implemented with substrate pnp bipolar transistors. There are two principal differences between the circuit of FIG. 5 and the circuit of FIG. 4. First, the resistor $R_4$ is moved to the emitter side of transistor $Q_5$. Second, current source $I_6$ is omitted. This means that the transistor $Q_5$ now has a collector current of $I-I_o$. However, the equation for $V_{out5}$ is equivalent to the expression for $V_{out4}$ (eqn. 11). Therefore, for certain resistor ratios, $V_{out5}$ can be made to be a fraction of the bandgap voltage.

In FIG. 5, as in FIG. 4, the output voltage $V_{out5}$ has to be set sufficiently high so that transistors Q3, Q4 and Q5 are turned on. In one embodiment for FIG. 5, $V_{out5}$ is preferably chosen to be about 0.9 V, which can be maintained for a supply voltage as low as 1.1 V. Further reduction in the operating supply voltage can be obtained for a reduced temperature range.

Thus, the circuit of FIG. 5 is a bandgap reference circuit wherein (i) the output voltage can be set equal to or less than the silicon bandgap voltage by adjusting resistor ratios, (ii) the output voltage can have a zero TC, and (iii) the operating supply voltage can be less than 1.5 V.

Although the present invention has been described above with particularity, this was merely to teach one of ordinary skill in the art how to make and use the invention. Many additional modifications will fall within the scope of the invention. Thus, the scope of the invention is defined by the claims which immediately follow.

What is claimed is:

1. A low-voltage reference circuit, comprising:

a first current source (I3);

a second current source (I4);

a third current source (I5);

a first bipolar junction transistor (Q3) having an emitter connected to the first current source (I3), and a collector and base connected to VSS;

a second bipolar junction transistor (Q4) having an emitter connected to the second current source (I4), and a collector and base connected to VSS;

a third bipolar junction transistor (Q5) having a collector, and having an emitter and base connected to VSS;

an NMOS transistor (M1) having a drain connected to the third current source (I5), a source, and a gate;

a first operational amplifier (A1) having an inverting (−) input connected to the first current source (I3), a noninverting (+) input connected to the second current source (I4), and an output connected to drive the first, second and third current sources (I3–I5);

a second operational amplifier (A4) having a noninverting (+) input, an inverting (−) input connected to the source of the NMOS transistor (M1) and having an output connected to the gate of the NMOS transistor (M1);

a first resistor (R3) having a first terminal connected to the second current source (I4) and having a second terminal connected to the emitter of the second transistor (Q4);

a second resistor (R4) having a first terminal connected to the third current source (I5), and having a second terminal connected to the collector of the third transistor (Q5);

a third resistor (R8) having a first terminal connected to the third current source (I5), and having a second terminal connected to the noninverting (+) input of the second amplifier (A4);

a fourth resistor (R9) having a first terminal connected to the noninverting (+) input of the second amplifier (A4), and having a second terminal connected to VSS;

a fifth resistor (R10) having a first terminal connected to the inverting (−) input of the second amplifier (A4), and having a second terminal connected to VSS.

2. The low voltage reference circuit of claim 1, wherein a size of the second transistor (Q4) is a multiple of a size of the first transistor (Q3).

3. The low voltage reference circuit of claim 1, wherein the first, second and third current sources (I3–I5) are formed from transistors having substantially equal sizes, with gates driven by the output of the first amplifier (A2).

* * * * *